US006517285B2

(12) United States Patent
Hill

(10) Patent No.: US 6,517,285 B2
(45) Date of Patent: Feb. 11, 2003

(54) METHOD AND SYSTEM FOR WATER CONSERVATION

(76) Inventor: Warwick Roy Hill, Croydon Park, Meandarra, Queensland 4422 (AU)

( * ) Notice: Subject to any disclaimer, the term of this patent is extended or adjusted under 35 U.S.C. 154(b) by 0 days.

(21) Appl. No.: 09/804,906

(22) Filed: Mar. 13, 2001

(65) Prior Publication Data

US 2002/0131822 A1 Sep. 19, 2002

(51) Int. Cl.[7] ..... E02B 15/06; E04H 4/10

(52) U.S. Cl. ..... 405/52; 405/129.9; 52/5; 52/169.14; 4/498; 210/170; 210/747

(58) Field of Search ..... 405/52, 53, 107, 405/114, 115, 129.9; 52/5, 169.7, 169.14; 4/498; 210/170, 747; 119/61–63

(56) References Cited

U.S. PATENT DOCUMENTS 3,683,428 A * 8/1972 Morris ..... 4/498
4,181,986 A * 1/1980 Aine ..... 4/499
4,192,025 A * 3/1980 Hinsperger ..... 4/498
4,251,889 A * 2/1981 Lof ..... 4/498
4,786,205 A * 11/1988 Hisken et al. ..... 405/53
5,108,225 A * 4/1992 Neal ..... 405/114
5,246,308 A * 9/1993 Brothers ..... 405/53
5,722,098 A * 3/1998 Stern ..... 4/498
5,911,662 A * 6/1999 Hallsten ..... 52/5
5,993,112 A * 11/1999 Neal ..... 4/498
6,338,169 B1 * 1/2002 DeGarie ..... 4/498

* cited by examiner

*Primary Examiner*—Thomas B. Will
*Assistant Examiner*—Tara L. Mayo
(74) *Attorney, Agent, or Firm*—Lloyd W. Sadler

(57) ABSTRACT

A method and system for water conservation relies upon the reduction of evaporative losses from water storages having a high ratio of surface area to depth. The system comprises a plurality of buoyant flexible membrane strips interconnected along adjacent edges and anchored by anchor members about the periphery of the water storage. The membrane strips include spaced apertures to prevent accumulation of rain water on upper surfaces thereof.

16 Claims, 4 Drawing Sheets

METHOD AND SYSTEM FOR WATER CONSERVATION

BACKGROUND OF INVENTION

This invention is concerned with a method and apparatus for conservation of water.

The invention is particularly concerned with the reduction of evaporation losses from water storages having a high ratio of surface area to water depth.

In many regions of Australia and elsewhere in the world, the capacity for sustainable horticulture is dependent on the availability of water.

In arid and semi-arid regions, a level of sustainable horticulture has been achieved by building large but relatively shallow water storage dams covering many hectares.

Water levels in such dams can be topped up in rainy seasons by drainage from catchment areas where the topography is appropriate or otherwise by pumping water from creeks or rivers when water is flowing therein.

A major disadvantage of such water storage systems is the high rate of water loss due to evaporation due to the combined effects of wind and water surface temperature.

Evaporative losses are generally measured in megalitres/hectare where a 100 mm reduction in water depth per hectare equals one megalitre.

In semi-arid areas where average annual rainfall may be of the order of 600 mm, evaporative losses during the summer are typically of the order of 18 megalitre/hectare or a reduction in water depth of 1.8 metres.

In more arid areas where average annual rainfall may be 200 mm or less, evaporative water losses of up to 30 megalitres/hectare have been recorded.

While the proportion of water lost by evaporation in water storage facilities can be reduced by increasing the depth/surface are ratio, this is generally uneconomical.

For large capacity water storage dams of many hectares in surface area, these are usually constructed on flat land (without a surrounding catchment area) by pushing up a perimetral wall of 2–3 metres in height with a bulldozer. It generally is not economically feasible to excavate large volumes of earth to form a water storage facility.

As far as the cost of evaporative losses are concerned, these may be measured by the cost of water purchased and/or the value of lost agricultural production.

Typically, in an irrigation area where water is pumped from a stream, the cost of a water allocation license may cost from $1000–$3000 as an initial fee and a seasonal pumping cost of about $25 per megalitre subject to volumetric limits. These costs are steadily increasing as water becomes scarcer due to seasonal variations and increased levels of horticulture.

If evaporative losses were to be measured in terms of lost agricultural production otherwise possible, the value per megalitre of water could range between $500 for a cotton crop up to $1000 or even higher for high value crops such as vegetables or the like.

Another problem associated with evaporative losses from open storage ponds is the risk of increased salinity in water applied to crops as water levels diminish due to evaporation. This problem can be exacerbated where the water is constantly held in storage i.e. the storage pond is never completely emptied to remove accumulated salt concentrations.

Over the years there has been extensive research into reduction of evaporative water losses.

Prior art proposals have included chemical, physical, and structural methods.

Typically, chemical methods comprise the use of a chemical monolayer on the water surface to reduce the evaporation rate. The most well known of these is the use of cetyl alcohol.

While chemical monolayers have proven useful in pilot studies on small surface areas, there are real practical difficulties in maintaining the integrity of the monolayer due to wind actions well as contamination and biodegration of the monolayer.

Physical methods of evaporation control include destratification to bring cooler water to the surface, however, this is of little value in reducing evaporative losses due to wind action.

Other physical methods have involved floating covers made from:

expanded perlite ore polystyrene beads foamed wax blocks white spheres butyl rubber sheets painted white polystyrene sheets and rafts white foamed wax in continuous layers foamed butyl rubber light grey asphaltic concrete blocks.

While encouraging results have been obtained with some of these systems (up to 80% reduction with floating concrete rafts) none are suited to very large water storages having a surface area of many hectares due to cost.

Structural methods including roofing of reservoirs have shown evaporation reductions of up to 90% but again, the cost of such structures is not feasible for large surface areas.

SUMMARY OF INVENTION

Accordingly, the present invention seeks to overcome or ameliorate at least some of the disadvantages of prior art water evaporation reducing systems and to provide, if not a more cost effective system, at least a useful alternative choice.

According to one aspect of the invention, there is provided, a system for reducing evaporation losses in a large surface area water storage, said system comprising:-a buoyant flexible membrane extending over a substantial portion of the surface of a body of water, said membrane being anchored by flexible anchoring means spaced about the periphery thereof and connected to a peripheral wall of said water storage, said membrane characterized in that it comprises a plurality of membrane elements engageable along respective adjacent edges thereof, said membrane further characterized in the provision of spaced apertures to prevent, in use, accumulation of rain water on an upper surface thereof.

Suitably, the flexible membrane is comprised of a natural or synthetic polymeric material.

If required, the flexible membrane may comprise a closed cell foam structure for buoyancy.

Alternatively the flexible membrane may comprise spaced buoyancy chambers.

Preferably the spaced buoyancy chambers extend over at least one surface of said membrane.

Most preferably the buoyancy chambers extend over a surface of said membrane, in use, in contact with the surface of the body of water.

The buoyancy chambers may be interconnected if required.

The membrane elements suitably comprise parallel sided members having telescopically engageable connection means extending adjacent opposed longitudinal edges.

Suitably the telescopically engageable connection means comprises an elongate socket-like element extending adjacent one edge of said membrane element and an elongate spigot-like element extending adjacent an opposite edge, each said socket-like element and spigot-like element being telescopically engageable in a respective complementary connection means of an adjacent membrane element.

Alternatively the membrane elements may comprise connection members spaced along opposite sides thereof. If required, the connection members may comprise apertured eyelets, interengageable hooks and eyes or hooks and eyes engageable by a cord member.

The flexible anchoring means suitably comprises cord-like members adapted for attachment to spaced anchor members located about the peripheral wall of said water storage.

According to another aspect of the invention there is provided a method of reducing the evaporative losses in a water storage, said method comprising the installation in a large surface area water storage of a system according to the first aspect of the invention.

BRIEF DESCRIPTION OF DRAWINGS

In order that the invention may be more readily understood and put into practical effect, reference is now made to a preferred embodiment illustrated in the accompanying drawings in which.

DETAILED DESCRIPTION

Figure 1:
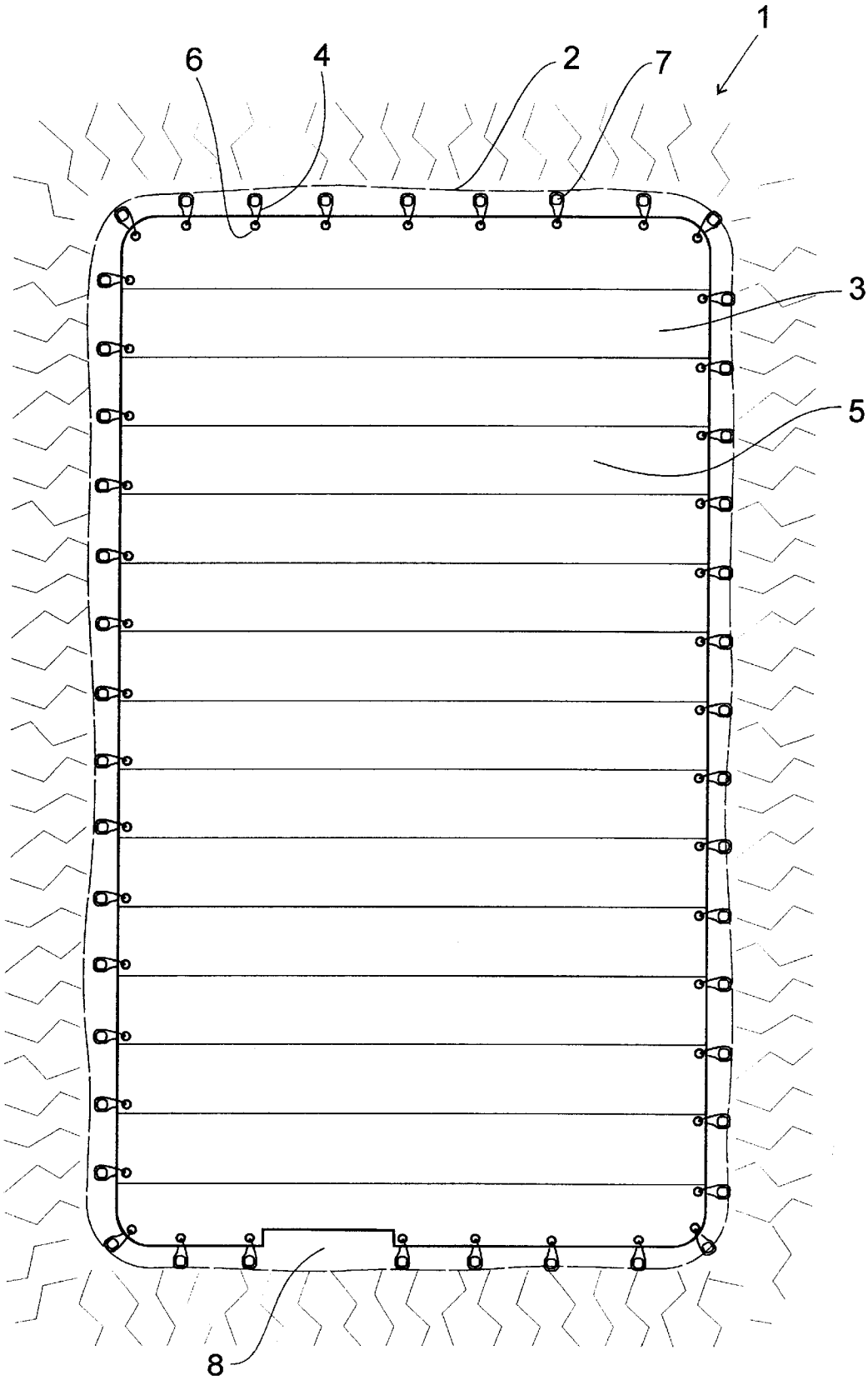
FIG 1 shows a water storage embodying a water evaporation reducing system according to the invention.

In FIG. 1 the water storage 1 comprises a raised earthen bank 2 with a buoyant membrane 3 anchored to the earthen bank 2 by flexible cords 4 secured at one end to the parallel sided membrane elements 5 by means of eyelets 5 or the like.

The other end of each cord 4 is secured to a peg 7 or other suitable anchor in the bank 2.

The flexible cords may comprise some degree of elasticity to accommodate movement of the membrane 3 as the water level rises or falls thereunder. Generally speaking however it is considered that there is sufficient resilience in the plastics or rubber membrane 3 to maintain sufficient tension in the cords 4.

If required, the membrane 3 may include one or more openings 8 about its periphery to permit stock to drink or otherwise to accommodate an inlet or outlet conduit (not shown).

Figure 2:
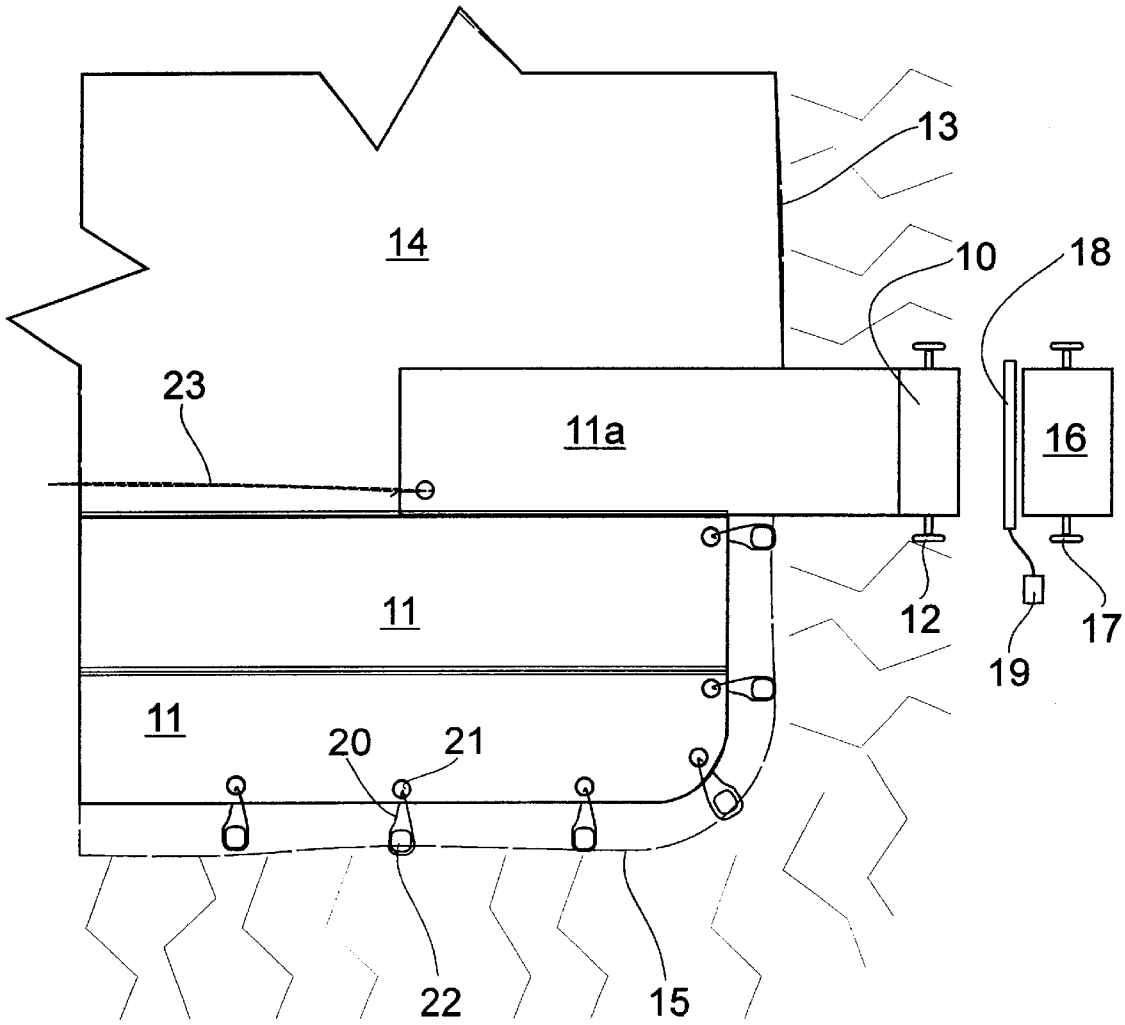
FIG. 2 shows schematically a method of installing the system illustrated in FIG. 1.

FIG. 2 shows one method of installing the system shown in FIG. 1.

A roll 10 of buoyant membrane material 11 of any suitable width typically from 3–5 metres or more is initially set up on a roll stand 12 outside the earthen bank 13 of the water storage 14 and at one end 15 thereof.

Using a rope or the like tied to the free end of the buoyant membrane 11, the free end is drawn over the surface of the water thereunder until the first roll 10 is nearly exhausted.

A second roll 16 of membrane material 11 is set up on a roll stand 17 behind the first roll 10 with a thermal welding device 18 such as a radio frequency welder therebetween, the welder being powered by a portable electric generator 19.

The tail of first roll 10 is welded to the beginning of roll 16 and the strip of membrane 11 is drawn across the surface of the water with further rolls of membrane material being added as required until the membrane strip reaches the opposite bank (not shown) of the water storage.

As an alternative, mechanical fastening means may be employed to join the ends of membranes 11.

Both ends of strip 11 and edge 11*a* are secured to the bank 13 by flexible cords 20 connected to eyelets 20 along the side and ends of the sheet 11, the cords 20 being secured at their opposite ends to pegs or stakes 22 in the earthen bank 13.

Roll-stands 10 and 17 with associated rolls of buoyant material 11*a*, 16, together with the strip welder 18 are then aligned with the free edge of the strip 11 floating on the surface of the water in storage 14.

An elongate spigot shaped telescopic connection means (not shown) along one side of new roll 11 is connected with an elongate socket shaped telescopic connection means (not shown) associated with an adjacent side of already installed strip 11*a*.

By means of a rope 23, new strip 11 a in telescopic engagement with adjacent strip 11, is drawn out over the surface of the water and the process is continued until substantially the entire surface area of the water storage 14 is covered by a continuous buoyant membrane comprising membrane elements joined along adjacent edges.

Suitably cord 23 is passed around a pulley (not shown) on the opposite earthen bank to enable a one person operation and otherwise to provide a free end of cord 23 for connection of a subsequent strip of membrane material.

The free ends of each strip are anchored progressively as they are installed and the free edge of the last strip is also anchored after installation to provide a secure integral barrier against evaporation due to thermal and/or wind effects.

The simplicity of the apparatus needed for installation enables ease of installation in remote areas with a minimum of labour content in order to minimize the cost/hectare of installation.

Over very large distances the friction between the telescopically engaging connection members may exceed the tensile strength of the strip of membrane and/or the connection member(s) under tension notwithstanding the presence of water as a lubricant.

In such circumstances a shorter panel may be drawn to the middle of the water storage from one side of the water storage and thereafter additional short panels are drawn from the same side of the water storage to abut the previous panel. The process is then repeated from the opposite side of the water storage to form an effective cover over the entire width of the water storage.

Figure 3:
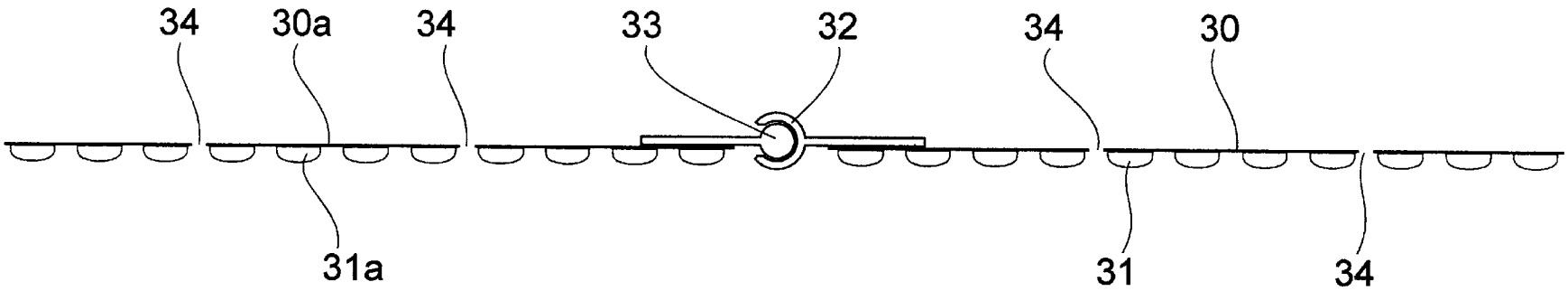
FIG. 3 shows an enlarged cross-sectional view of the telescopically interengageable connection means of the buoyant membrane.

FIG. 3 shows schematically the telescopic connection between adjacent strips of buoyant membrane material.

Suitably the membrane 30 comprises a laminated thermoplastics material having a plurality of air filled buoyancy chambers 31 extending from a lower surface.

Alternatively as shown by membrane 30*a*, the buoyancy chambers 31*a* may comprise spaced transversely and/or longitudinally extending air filled chambers.

Secured along opposing sides of the membrane are extruded members 32, 33 in the form of elongate socket and spigot shaped telescopically engageable connection members.

The connection members 32, 33 may be secured to the membrane sides by any suitable means such as stitching, adhesive material or by thermoplastic welding.

Located between the buoyancy chambers 31 (or 31*a*) are apertures 34 at spaced intervals. These apertures, in use, prevent ponding of rainwater on the upper surface of the membrane which might otherwise cause the membrane to sink in parts and apply excessive tension in the anchoring means.

The clearance between the complementary socket and spigot connectors is sufficiently great as to permit low friction telescopic engagement, particularly in the presence of water as a lubricant, but otherwise to maintain sufficient structural integrity to prevent being pulled apart in high wind conditions.

By placing the protruding buoyancy chambers on the underside of the membrane, the contact area with the water is increased substantially to reduce the wind lift factor.

In addition by providing a relatively smooth upper surface to the membrane, collection of dust, leaves and other debris is minimized and the smooth upper surface will be cleaned by rain and wind action.

Figure 4:
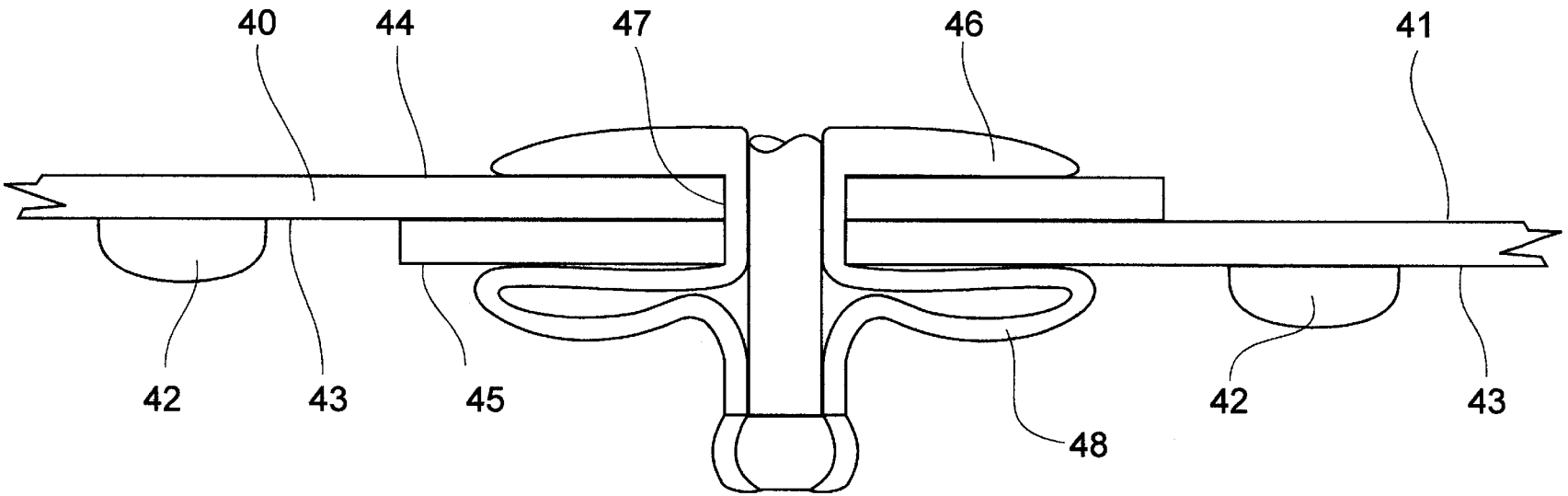
FIG. 4 shows an alternative connection between adjacent membrane elements.

FIG. 4 shows an alternative method of connecting adjacent membrane elements 40, 41.

As shown, elements 40, 41 comprise laminates of plastic film having spaced buoyancy chambers 42 over at least a lower surface 43 thereof.

Opposite side edge regions 44, 45 of the membrane elements may be free of buoyancy chambers and permit free overlapping of regions 44, 45.

A fastener 46 of a type similar to that used in the aircraft industry for joining thin sheets of aluminum alloy or the like is inserted from one side (typically the top) of the overlapped region to form a pierced aperture 47 and the fastener 46 is then actuated by an actuating tool to cause finger-like elements 48 to frictionally engage against the underside of fastener 46 in the region of collar 49 to securely clamp the membrane elements 40, 41 together.

A suitable type of fastener may be a "BULBEX" type rivet-like fastener available from Textron Inc. or a similar fastener suitable for plastic sheets, with or without localized reinforcing e.g., washers.

Although the membrane may be comprised of any suitable polymeric material such as polyvinyl chloride, polyethylene butyl rubbers or any other polymeric material having suitable mechanical and physical properties, the raw material costs and manufacturing methods for sheet like membranes will mitigate against many of these polymers.

It is considered that "layflat" polyethylene film provides the best compromise between cost and available film width.

Moreover, as film appearance is unimportant it is considered that reclaimed polyethylene, pigmented black or white, with or without an appropriate ultra-violet light stabilizer will provide a cost effective membrane material with adequate resistance to weathering of between 2–5 years before replacement becomes necessary.

To further reduce costs, it is considered that the buoyant membranes according to the invention may be manufactured on site from rolls of "layflat" polyethylene film and rolls of extruded socket and spigot telescopic connector means.

Layflat film up to 3 metres in width is available as a flattened tube in rolls in excess of 100 metres.

A portable laminator could for example comprise say a 3 metre wide hollow drum having a pattern of perforations in its outer surface in fluid communication with a vacuum pump.

As the double layer of film passes over a region of reduced internal pressure in the drum, the lower layer of film is vacuum formed with a plurality of hollow protrusions extending partly into the drum perforations.

An oil heated laminating roller then fuses the upper layer of the film to the lower layer thereby forming closed cell buoyancy chambers.

The 3 metres wide strips may then be welded together along adjacent edges by a simple continuous thermal welding device to form membrane elements of from say, 9–15 metres in width.

The extruded socket and spigot strips may be attached again by a continuous thermal welding process in a separate step or as the membrane elements are drawn across the surface of the water during installation.

It will be readily apparent to a skilled addressee that many modifications and variations may be made to the invention without departing from the spirit and scope thereof.

For example, instead of a telescopic engagement between adjacent strips of membrane, the strips may be secured along adjacent edges by lacing or by any other suitable spaced mechanical connectors such as aligned eyelets, sheet material fasteners or the like, the connection being effected from a small floating platform or boat moving between the edges of adjacent membrane strips.

In another embodiment each strip of membrane may be formed with apertured eyelets spaced along one longitudinal edge and transversely aligned hook members spaced along an opposite edge.

Adjacent strips of membrane may then be connected by engaging the adjacent hooks and eyes of respective strips of membrane from a floating platform or alternatively by connecting a cord, laced through the spaced eyes along one edge of a strip of membrane, with hooks spaced along an adjacent edge of an adjacent strip of membrane.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

What is claimed is:

1. A system for reducing evaporation losses in a large surface area water storage, said system comprising:

a buoyant flexible membrane extending over a substantial portion of the surface of a body of water, said membrane being anchored by flexible anchoring members spaced about the periphery thereof and connected to a peripheral wall of said water storage, said membrane characterized in that it comprises a plurality of buoyant flexible membrane elements engageable along respective adjacent edges thereof, wherein the flexible member elements comprise spaced buoyancy chambers, said membrane further characterized in the provision of spaced apertures to prevent, in use, accumulation of rain water on an upper surface thereof.

2. A system as claimed in claim 1 wherein the flexible membrane elements are comprised of a natural or synthetic polymeric material.

3. A system as claimed in claim 2 wherein the flexible membrane elements comprises a closed cell foam structure for buoyancy.

4. A system as claimed in claim 1 wherein the spaced buoyancy chambers extend over at least one surface of each said membrane element.

5. A system as claimed in claim 4 wherein the buoyancy chambers extend over a surface of said membrane elements, in use, in contact with the surface of the body of water.

6. A system as claimed in claim 1 wherein the buoyancy chambers are interconnected.

7. A system as claimed in claim 1 wherein the membrane elements comprise parallel sided members having telescopically engageable connection means extending adjacent opposed longitudinal edges.

8. A system as claimed in claim 7 wherein the telescopically engageable connection means comprises an elongate socket-like element extending adjacent one edge of said membrane element and an elongate spigot-like element extending adjacent an opposite edge, each said socket-like element and spigot-like element being telescopically engageable in a respective complementary connection means of an adjacent membrane element.

9. A system a claimed in claim 1 wherein the membrane elements include connection members spaced along opposite sides thereof.

10. A system as claimed in claim 9 wherein the connection members comprise apertured eyelets, interengageable hooks and eyes or hooks and eyes engageable by a cord member.

11. A system as claimed in claim 9 wherein the connection members are insertable from one side of an overlapped region between adjacent membrane elements.

12. A system as claimed in claim 1 wherein the flexible anchoring members comprises cord-like members adapted for attachment to spaced anchors located about the peripheral wall of said water storage.

13. A method for reducing evaporative losses in a large surface area water storage, said method comprising the installation over the surface of a body of water in said water storage of a buoyant flexible membrane extending over a substantial portion of a body of water, said membrane being anchored by flexible anchoring members spaced about the periphery thereof and connected to a peripheral wall of said water storage, said membrane characterized in that it comprises a plurality of buoyant flexible membrane elements engaged along respective adjacent edges thereof, wherein the flexible member elements comprise spaced buoyancy chambers, said membrane further characterized in the provision of spaced apertures to prevent, in use, accumulation of rainwater on an upper surface thereof.

14. A method as claimed in claim 13 wherein membrane elements are successively extended over the surface of said body of water and connected together at respective adjacent edges thereof.

15. A method as claimed in claim 14 wherein said membrane elements are extended over the surface of said body of water by drawing a free end of a membrane element over the surface of said body of water from one peripheral wall of said water storage to an opposite peripheral wall.

16. A method as claimed in claim 13 wherein adjacent membrane elements are engaged along respective adjacent edges thereof by overlapping said respective adjacent edges and inserting a connection member through said overlapping respective adjacent edges from one side thereof and actuating said connection member.

* * * * *